US012269668B2

(12) United States Patent
Heatley

(10) Patent No.: US 12,269,668 B2
(45) Date of Patent: Apr. 8, 2025

(54) AEROSOL CAN ACTIVATOR

(71) Applicant: SEYMOUR OF SYCAMORE INC., Sycamore, IL (US)

(72) Inventor: Christopher Packard Heatley, McHenry, IL (US)

(73) Assignee: SEYMOUR OF SYCAMORE INC., Sycamore, IL (US)

( * ) Notice: Subject to any disclaimer, the term of this patent is extended or adjusted under 35 U.S.C. 154(b) by 0 days.

(21) Appl. No.: 18/079,526

(22) Filed: Dec. 12, 2022

(65) Prior Publication Data

US 2023/0219739 A1 Jul. 13, 2023

Related U.S. Application Data

(60) Provisional application No. 63/298,695, filed on Jan. 12, 2022.

(51) Int. Cl.
*B65D 83/28* (2006.01)
*B65D 83/20* (2006.01)

(52) U.S. Cl.
CPC ..... *B65D 83/202* (2013.01); *B65D 83/28* (2013.01)

(58) Field of Classification Search
CPC ..... B65D 83/28; B65D 83/30–306; B65D 83/384; B65D 83/201–202; B05B 12/002; B05B 12/63; B05B 7/2478
USPC ..... 222/402.15, 473–474, 323; 239/375; 248/312
See application file for complete search history.

(56) References Cited

U.S. PATENT DOCUMENTS 2,877,934 A * 3/1959 Wallace ..... B65D 83/202 222/472
3,045,878 A * 7/1962 Blanford ..... B65D 83/202 222/402.15
3,314,426 A * 4/1967 Carroll ..... A61F 9/0008 222/394
3,506,159 A * 4/1970 Muller ..... B65D 83/202 222/323
3,659,791 A * 5/1972 Clark ..... B65D 83/202 239/375
3,734,357 A * 5/1973 Batistelli ..... B65D 83/202 222/323
3,815,819 A * 6/1974 Hamlin ..... B65D 83/202 118/301

(Continued)

FOREIGN PATENT DOCUMENTS

WO WO-2023027574 A1 * 3/2023

*Primary Examiner* — Paul R Durand
*Assistant Examiner* — Randall A Gruby
(74) *Attorney, Agent, or Firm* — McDonnell Boehnen Hulbert & Berghoff LLP

(57) ABSTRACT

An activator for use with an aerosol spray can is presented having a two-part housing formed from a first side and a second side that when aligned and connected together retains a trigger that is pivotally attached to one of the first and second sides. Snap fittings or a can adjuster can be used to slidably engage with the spray can to securely hold the spray can and preventing axial movement relative to the housing. A nozzle elbow is movable contained within the housing having a distal end and a proximal end, where the proximal end accepts and operatively connects with a valve stem on the spray can. A spray head is releasably positioned in the distal end of the elbow nozzle.

13 Claims, 9 Drawing Sheets

(56) References Cited

U.S. PATENT DOCUMENTS 3,841,533 A * 10/1974 Carroll ..... B65D 83/30 128/200.23
3,936,000 A * 2/1976 Weyn ..... B65D 83/30 222/182
4,158,361 A * 6/1979 Kotuby ..... A61F 9/0008 604/302
4,248,360 A * 2/1981 Crump ..... B65D 83/208 222/402.15
4,401,240 A * 8/1983 Brack ..... B65D 83/202 222/323
4,432,474 A * 2/1984 Hutchinson ..... B65D 83/202 222/402.15
4,449,647 A * 5/1984 Reed ..... B65D 83/7575 220/759
4,505,335 A * 3/1985 Hayba ..... B65D 83/202 222/402.15
4,579,258 A * 4/1986 Brown ..... B65D 83/202 222/323
D283,801 S * 5/1986 Brown ..... D23/225
D287,394 S * 12/1986 Yamamoto ..... D23/225
4,805,812 A * 2/1989 Brody ..... B65D 83/202 222/402.15
4,971,257 A * 11/1990 Birge ..... B65D 83/384 222/402.15
5,323,937 A * 6/1994 Brody ..... B65D 83/202 222/402.15
5,344,076 A * 9/1994 Mercurio ..... A45D 34/00 239/288.5
5,415,351 A * 5/1995 Otto ..... B05B 7/2478 239/394
5,518,148 A * 5/1996 Smrt ..... B65D 83/202 222/174
5,615,804 A * 4/1997 Brown ..... B05B 12/002 222/394
5,755,363 A * 5/1998 Gantner ..... B05B 12/002 222/402.15
5,769,279 A * 6/1998 Smrt ..... B65D 83/203 222/174
5,819,985 A * 10/1998 Brody ..... B65D 83/22 222/402.15
5,904,273 A * 5/1999 Aspacher ..... B65D 83/202 222/402.15
6,016,938 A * 1/2000 Eichorst ..... B65D 83/202 222/402.15
6,029,862 A * 2/2000 Jones ..... B65D 83/202 222/402.15
6,364,177 B1 * 4/2002 Taylor ..... B65D 83/202 222/402.15
D459,438 S * 6/2002 Knowles ..... D23/225
6,896,192 B2 * 5/2005 Horan ..... G01B 11/026 239/289
6,981,622 B2 * 1/2006 Brody ..... B65D 83/202 222/402.15
7,000,805 B1 * 2/2006 Wu ..... B05B 12/002 222/323
7,431,222 B2 * 10/2008 Monterrosa ..... B65D 83/30 239/518
7,686,193 B1 * 3/2010 Gervais ..... B65D 83/202 222/323
7,721,920 B2 * 5/2010 Ruiz De Gopegui . B65D 83/38 222/402.1
7,743,950 B2 * 6/2010 Tsai ..... B65D 83/202 222/323
7,753,237 B2 * 7/2010 Tsai ..... B65D 83/202 222/323
7,766,196 B2 * 8/2010 Sugano ..... A01M 7/0046 222/323
8,052,015 B2 * 11/2011 Huang ..... B65D 83/202 222/323
8,272,542 B2 * 9/2012 Becker ..... B65D 83/202 222/323
8,444,020 B1 * 5/2013 Kenny ..... B65D 83/203 222/402.15
8,701,945 B2 * 4/2014 Hoagland ..... B65D 83/201 222/402.13
D705,652 S * 5/2014 Harrower ..... B05B 15/16 D9/448
8,714,416 B2 * 5/2014 Becker ..... B05B 12/002 222/323
8,844,775 B2 * 9/2014 Demey ..... B05B 1/3073 222/402.1
9,010,572 B2 * 4/2015 Demey ..... B65D 83/303 222/402.1
10,308,420 B2 * 6/2019 Speck ..... B65B 39/02
10,329,078 B1 * 6/2019 Alonso ..... B65D 83/202
10,351,335 B1 * 7/2019 Alonso ..... B65D 83/20
10,526,132 B2 * 1/2020 Schroer ..... B65D 83/206
10,611,554 B2 * 4/2020 Schroer ..... B65D 83/201
10,654,055 B1 * 5/2020 Alonso ..... B65D 83/202
10,822,156 B2 * 11/2020 Callahan ..... B65D 83/30
10,919,688 B2 * 2/2021 Schroer ..... B65D 83/303
10,940,990 B1 * 3/2021 Musterman, IV ... B65D 83/201
2004/0141797 A1 * 7/2004 Garabedian ..... A47L 13/256 401/278
2006/0006198 A1 * 1/2006 Lasserre ..... B05B 11/1059 222/383.1
2006/0060614 A1 * 3/2006 Garner ..... B65D 83/75 222/402.1
2006/0071036 A1 * 4/2006 Gervais ..... B65D 83/203 222/402.15
2006/0255077 A1 * 11/2006 Sugano ..... B65D 83/202 222/402.15
2007/0119877 A1 * 5/2007 Weltzin ..... B65D 83/7532 222/536
2009/0294615 A1 * 12/2009 Huang ..... B65D 83/202 248/229.22
2010/0051652 A1 * 3/2010 Becker ..... B05B 12/002 222/472
2010/0176224 A1 * 7/2010 Hasselschwert ..... B65D 83/202 239/708
2012/0080455 A1 * 4/2012 Jug ..... B65D 83/202 222/402.15
2012/0292337 A1 * 11/2012 Becker ..... B05B 12/002 222/402.15
2012/0315823 A1 * 12/2012 Brzezinski ..... A63H 33/009 239/211
2013/0320045 A1 * 12/2013 Hoagland ..... B05B 1/3046 222/402.1
2014/0224828 A1 * 8/2014 Demey ..... B65D 47/12 222/23
2014/0263417 A1 * 9/2014 Hanson ..... B05B 7/2472 222/402.1
2022/0396413 A1 * 12/2022 Vasiliades ..... B05B 15/63
2024/0383668 A1 * 11/2024 Ong ..... B05B 15/63

* cited by examiner

AEROSOL CAN ACTIVATOR

CROSS REFERENCE TO RELATED APPLICATIONS

The present application claims priority to U.S. Provisional Patent Application No. 63/298,695 filed Jan. 12, 2022 which is herewith incorporated by reference into the present application.

TECHNICAL FIELD

This disclosure is directed to an activator and dispensing aid for use with an aerosol spray can. More specially, the activator is for use with aerosol cans that do not contain a standard long dip tube and that are specifically manufactured for use in an inverted position.

BACKGROUND

One of the most significant developments in the field of liquid applications, including deodorants, air fresheners, paints and sunscreen, is the introduction and development of the aerosolized spray container, most commonly referred to as an "aerosol can" or "spray can." Retail stores have shelf upon shelf of these pre-filled pressurized containers filled with all sorts of liquids. These aerosol containers are ubiquitous and are used to deliver of great number of liquid products in a convenient spray or atomized stream. Regardless of the specific product to be delivered, one common ingredient of these aerosol containers is a propellant that acts as a carrier to dispense the product. Because the propellants are highly volatile, the container is pressurized to keep the propellant as a liquid. In the case of a spray paint container, these propellants are typically hydrocarbons that must be injected into the container under high pressure during manufacturing and maintained under pressure using valve that biased in a closed position.

To use most commercially available aerosol spray cans requires a user to operate, i.e., open a valve that is typically in a biased closed positioned. Typically, such valves are spring loaded, meaning that a user must overcome a biasing force that maintains the valve in a closed positioned until use or activation. In order to dispense the product, the can must be held or maintained in an activated state by the user, typically by pushing down on a spray head that in turn pushes down on a valve stem connected to a dip tube submerged into the liquid product within the can. When the user pushes or activates the container valve, the liquid propellant is flashed (vaporized) through a spray nozzle or tip carrying with it the liquid product as atomized droplets.

Devices, holders and activators designed for use with aerosol spray cans are known. The art recognizes a number of different designs to assist a user in overcoming the valve biasing force in order that the aerosol spray is delivered to an intended target or location. When using such aerosol containers for activities such as painting it is difficult to obtain a good finish as it is difficult to consistently hold the can vertical and to also provide constant pressure on the spray head to overcome the spring force that is biasing the valve into a normal closed position. Also, elderly and disabled people can find such containers difficult to use, and particularly if they suffer from conditions such as arthritis. Because most spray are manufactured with a dip tube that extends from the valve located at the top of the can down to the bottom portion of the can, the can must be held upright during use, i.e., the valve and attached spray head at the most vertical position relative to the ground.

Accordingly, there exists a continuing need to have aerosol can activators that allow a user to easily activate the spring biased valve while maintaining the can in a correct and consistent orientation while the product is dispensed. The present disclosure substantially fulfills this need by now providing a new and improved activator for a liquid spray container that is specifically designed to hold a container in an inverted position relative to the direction of spray.

SUMMARY

The present disclosure includes an aerosol spray can activator having a two-part housing comprising a first side and a second side, with a separate trigger that is pivotally attached to either of the first side or the second side and which is held in place when the two sides are connected or fastened to each other through a plurality of connectors located in each side that aligned and cooperate with each other when the two sides are married or aligned together to form the completed housing. The activator may have a snap fit connector to slidably accept and secure the domed portion of a spray can such that the can is held in a generally inverted position. Alternatively, the activator may also have a can adjuster associated with the housing that can be slidably adjusted to accept and hold a variety of can lengths within the sleeve portion of the activator. This can adjuster is configured and designed to prevent unwanted axial movement of the can when it is positioned in the housing. The activator is configured to accept a nozzle elbow that is directly connected to the valve stem of the spray can or that is positioned within the housing as a separate part. In both possible designs the nozzle elbow is movably associated with the trigger. The nozzle elbow can have a distal end and a proximal end, where the proximal end accepts the valve stem of an aerosol spray can. The distal end refers to a location closest to any opening that discharges the contents of the aerosol can upon activation of the valve.

A spray head can be releasably positioned in the distal end of the nozzle elbow and has outlet opening that generates a predetermined spray pattern of the aerosolized liquid being discharged from the can. This spray head can be configured to be adjustable by a user to change the spray pattern and/or direction of the spray delivered through the outlet opening. The first and second housing sides preferably have a can holder portion and a trigger portion, where the two can holder portions when connected to each other defines a sleeve that will accept an aerosol spray can, most preferably a cylindrical can. The sleeve has a longitudinal axis that forms an angle with the spray head outlet opening that is greater than 0 degrees and less than 90 degrees. In other words, the aerosol can will be in a generally inverted position when the can is placed within and secured to the sleeve. This generally inverted position is contrary to the upright or vertical position that is necessary for a conventional aerosol spray can to function. Such conventional spray cans have extended dip tubes that run the length of the can from the valve located at the end of the dome-shaped top of the can to the bottom of the can. These types of spray cans must be held upright such that the spray head outlet opening forms an angle with the longitudinal axis of the spray can that is approximately 90 degrees. This required upright position allows the extended/long dip tube to receive the pressurized liquid from the bottom portion of the can. If such a conventional aerosol can were inverted during use, the liquid level in the can could fall below the opening in the dip tube such that the liquid would not be forced up into the dip tube and through the valve stem, resulting in an even flow (sputtering) of liquid due to fact that mostly the propellent is being discharged through the spray head.

The trigger portions of each side of the housing are configured to hold the trigger as a separate, individual component, in a pivotally connected orientation relative to the housing. Preferably, each of the first side and the second side are each manufactured as single parts. In other words, each side of the housing is manufactured with a can holder portion and trigger holder portion as a single integral part, preferably through a molding operation. The inner or trigger holder portion of either of the two sides can be configured to hold a separate trigger assembly, which can include an integral resilient biasing member or alternatively a biasing member connector that can be attached to one end of a separate biasing member, such as a compression spring or leaf spring. When the two sides of the housing are aligned and connected together the completed sleeve and trigger handle are each formed. The sleeve is configured to have a lower portion and an upper portion, where the lower portion is preferably shaped to accept a dome configuration of the aerosol spray can. This is most conveniently accomplished by having each can holder portion of each side of the housing configured in the shape of the dome portion of a conventional spray can. The lower portion can be frusto-conical shaped to aid in controlling the width of the spray pattern.

As mentioned, the activator can have one or more snap fittings on the inside lower portion or can utilize a can adjuster that is slidably positioned in the upper portion of the sleeve and is configured to accept various lengths of spray cans. The snap fittings are configured to slidably accept and secure the beaded surface that connects the domed portion of the spray can to the cylindrical body of the spray can. The snap fittings function in a similar fashion as a conventional cap that is secured to the top of a spray can. In other words, the snap fittings allow the spray can to be removably attached to the activator yet providing a secure connection that prevents unwanted axial movement relative to the activator. The alternative use of a can adjuster is readily accomplished by incorporating an adjustable lock as part of the can adjuster that is configured to engage the aerosol can to prevent axial movement of the can relative to the sleeve. Preferably, the lock is slidably adjustable and is in ratchet engagement with the sleeve. The can adjuster also can have a stop feature that acts as bearing surface to engage a bottom edge of the can to prevent axial movement of the can relative to the housing when the can is fully positioned inside the sleeve. A preferred configuration of the can adjuster includes one or more flexible arms comprising a row of ratchet teeth, where the ratchet teeth releasably and slidably engage a row of corresponding ratchet teeth positioned on one of the first side or the second side of the housing. The flexible arm can be configured such that the user pushes or squeezes the arm in an inward direction to disengage the ratchet teeth from the corresponding set of teeth on one side of the housing to allow the can adjuster to be slidably positioned facilitating placement of the aerosol can in the sleeve.

The trigger that is positioned and held in place by the trigger portions of the first and second sides of the housing has a top and bottom, where the top comprises a bearing surface configured to engage the nozzle elbow when the trigger is squeezed (pushed proximally) by a user. The trigger can be biased such that the valve stem is in a normally closed position by at least two methods. The first method uses a separate biasing member, such as a compression spring or leaf spring, where one end of the biasing member is engaged with, or fixedly attached to, the trigger and the other end abuts, attached or otherwise engaged with a portion of the inside of the handle. In such a configuration, the user must squeeze the trigger to overcome the oppositely directed biasing force exerted by the biasing member. When the user releases the trigger, the biasing member will push the trigger to the starting or relaxed position, which then releases the pressure on the valve stream that in turn closes the valve in the spray can.

Alternatively, the bottom of the trigger can have an integral resilient member that biases the trigger into a non-activated position when the activator in not in use. In the non-activated position, the bearing surface does not exert a force on the nozzle elbow and, as such, does not open the aerosol can valve even though the can is securely in place within the sleeve. The resilient member is preferably formed as part of the trigger and is not a separate component. In other words, the trigger is manufactured as a single component and the resilient member is an integral part of the trigger. The trigger can be pivotally attached to a protruding post that transversely extends from an inside surface of one of the first or second sides of the housing. When a user squeezes the trigger, the post allows the trigger to pivot relative to the handle of housing.

A preferred configuration for the nozzle elbow is where the distal end and proximal end of the nozzle elbow are offset from each other at an angle that is equal to the angle defined between the longitudinal axis of the sleeve and spray head outlet opening. The nozzle elbow further comprises a bearing surface on an outside surface that is configured to engage a corresponding bearing surface on the trigger when the trigger is moved, i.e., pivoted, relative to the housing. The bearing surface on the nozzle elbow preferably comprises one or more transverse protruding ledges. Squeezing of the trigger causes the proximal end of the elbow nozzle to move axially parallel to the longitudinal axis. At the same time, the spray head moves axially a short distance along a centerline of the outlet opening when the trigger is pivoted relative to the housing. As mentioned, it is preferable that the spray head is both adjustable and releasably positioned in the distal end of the nozzle elbow.

Locating the pivot point or point of attachment of the trigger in the bottom of the trigger provides the greatest amount of leverage to activate (push) the valve stem of the aerosol can when the user squeezes the trigger. In other words, locating the pivot point at the bottom of the trigger and squeezing the top part of trigger exerts a maximum amount of axial force on the nozzle elbow that is transmitted along the longitudinal axis of the aerosol can. As such, a relatively light trigger squeeze easily overcomes the spring biased valve in the spray can.

Still further advantages of the present invention will become apparent upon reading and understanding the following detailed description of preferred embodiments. The invention also may take form in various parts and arrangement of parts. The accompanying drawings are only for purposes of illustrating preferred embodiments and are not to be construed as limiting the invention.

BRIEF DESCRIPTION OF THE FIGURES

The advantages and features of the present invention will become better understood with reference to the following more detailed description and claims taken in conjunction with the accompanying drawings, in which like elements are identified with like symbols, and in which:

DETAILED DESCRIPTION

Figure 1:
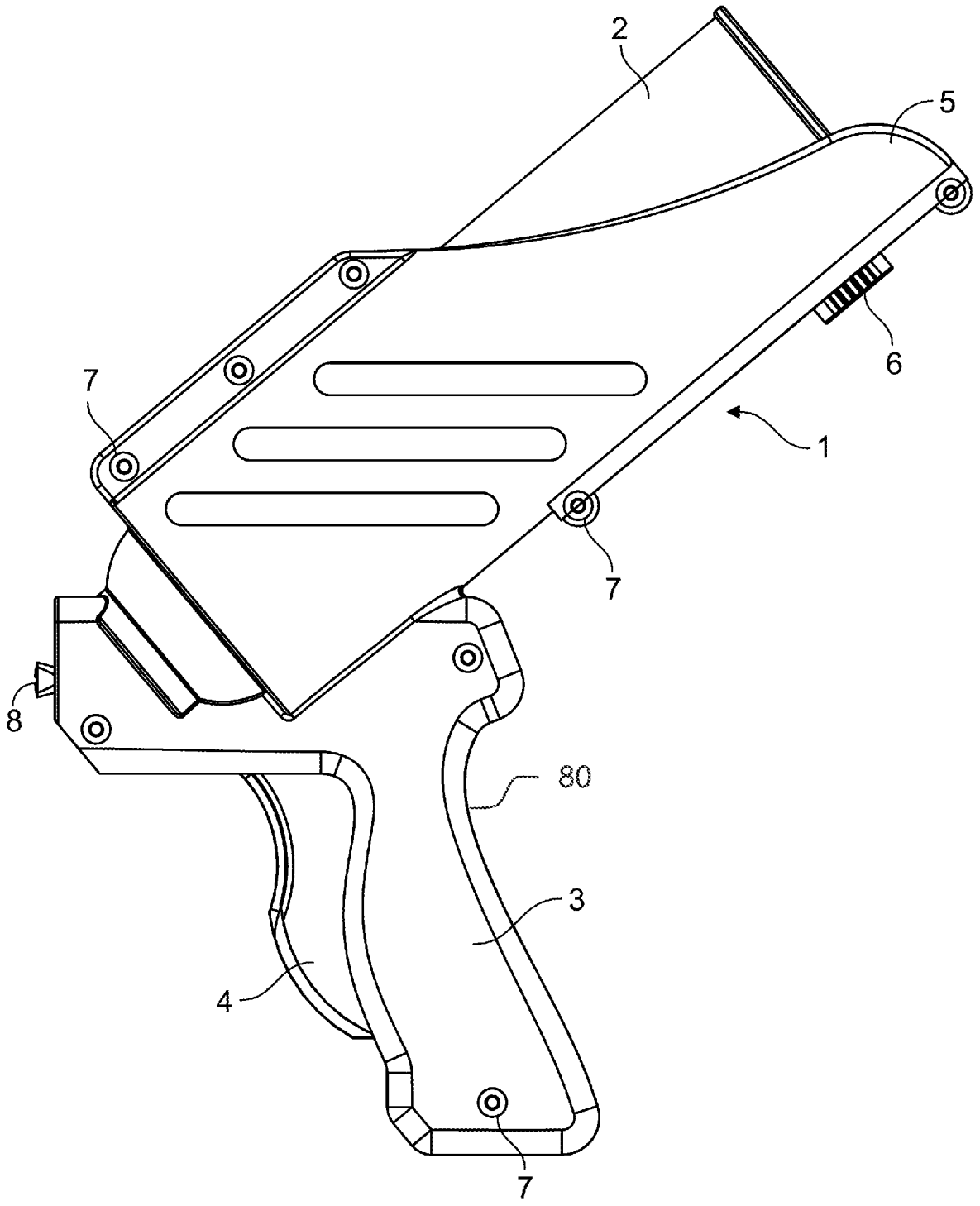
FIG. 1 is a side view of one possible configuration of the spray can activator of the present disclosure having a spray can positioned within the sleeve of the activator.
Figure 3:
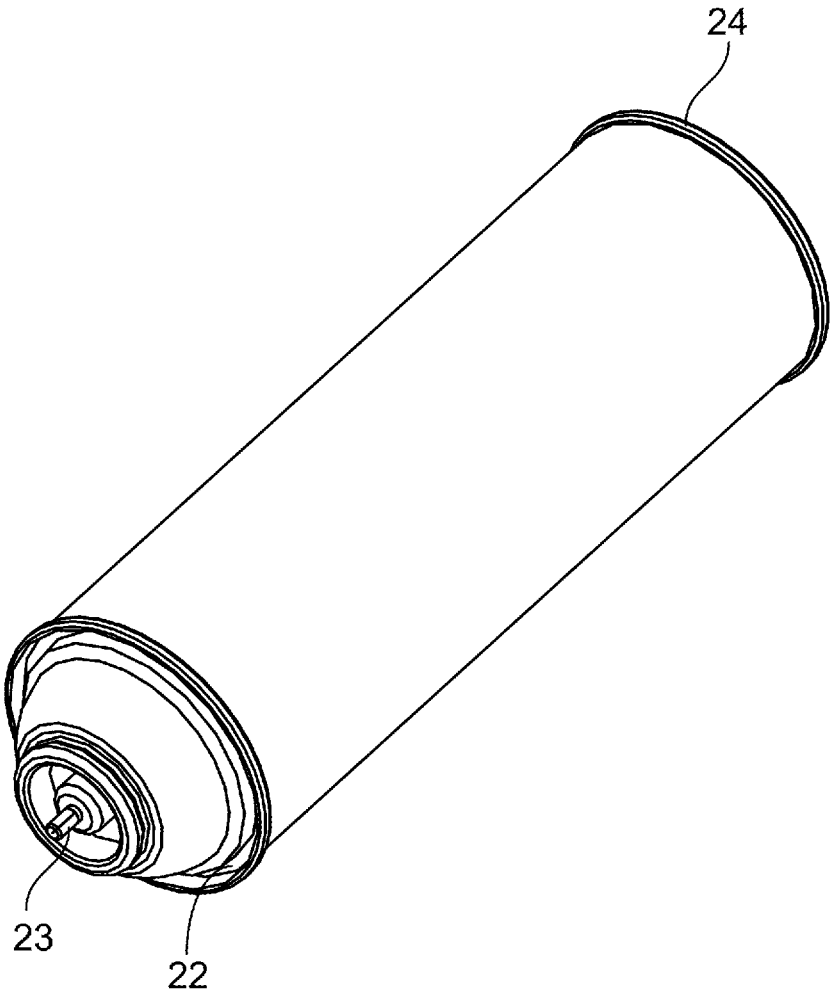
FIG. 3 is a perspective view of one possible type of spray can that can be used with the activator of the present disclosure.

The present disclosure is directed to an activator for use with an aerosol spray can. One possible design of the activator is shown in FIG. 1 where a spray can 2 is located in the sleeve 5 of the activator 1 and held in an inverted position that is less than 90 degrees vertical and greater than 0 degrees horizontal. One example of a spray can 2 is illustrated in FIG. 3 having a dome shaped top 22, a bottom rim 24 and a valve stem 23. Activator 1 is designed for spray cans that do not use a conventional extended or long dip tube, i.e., a dip tube that is the approximate length of the inside of the can. The activator of present disclosure is for spray cans that have no dip tube at all, or have a very short dip tube, such that the liquid level contained with the can does not fall below the opening in the dip tube when the can is positioned in the activator in the inverted position as shown in FIG. 1. Having no dip tube, or a very short dip tube, allows substantially all of the liquid initially loaded into the can during manufacture to be dispensed by a user using the activator of the present disclosure.

Figure 2:
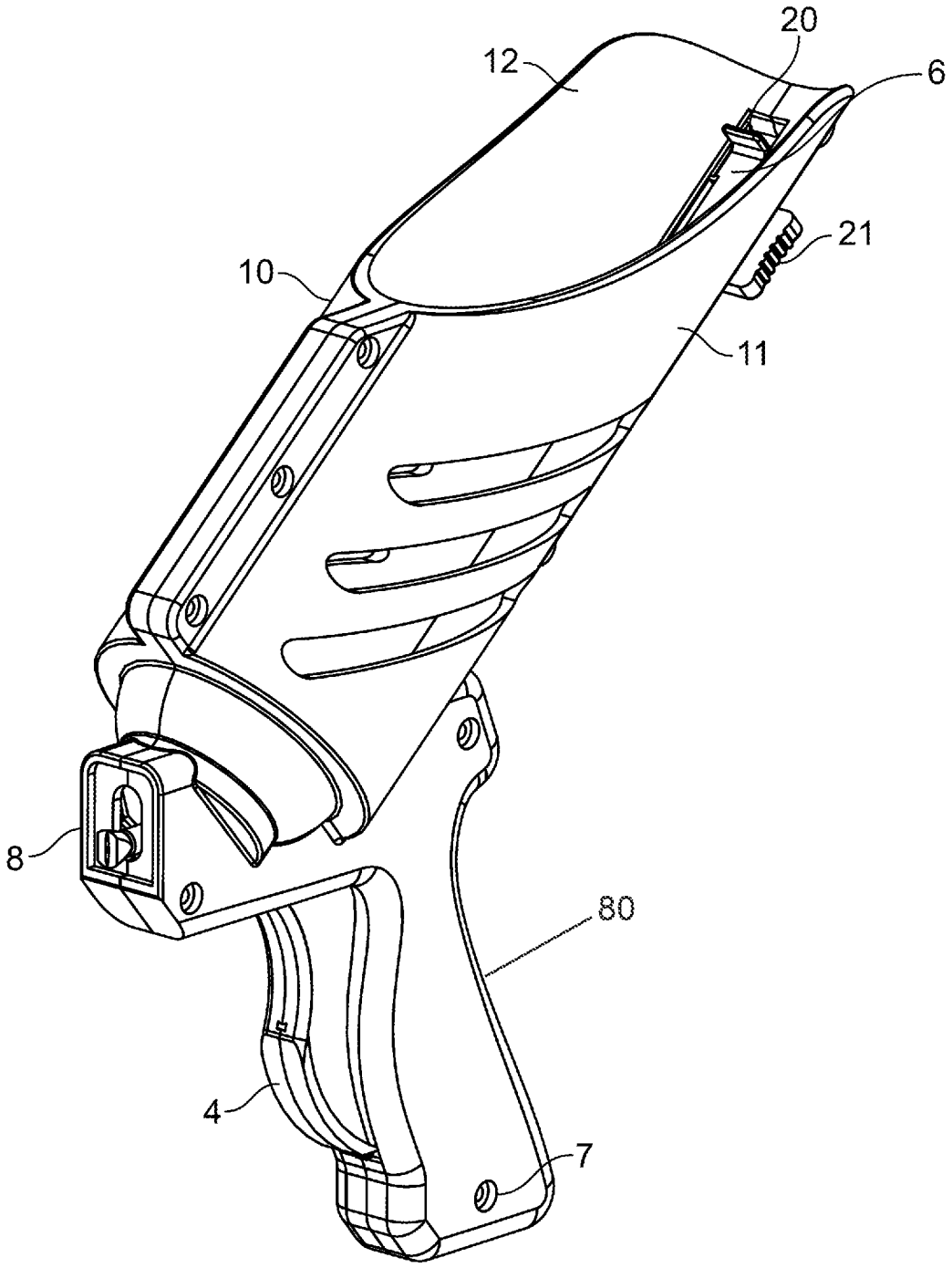
FIG. 2 is a perspective view of the spray can activator shown in FIG. 1 without a spray can positioned within the sleeve of the activator.
Figure 6:
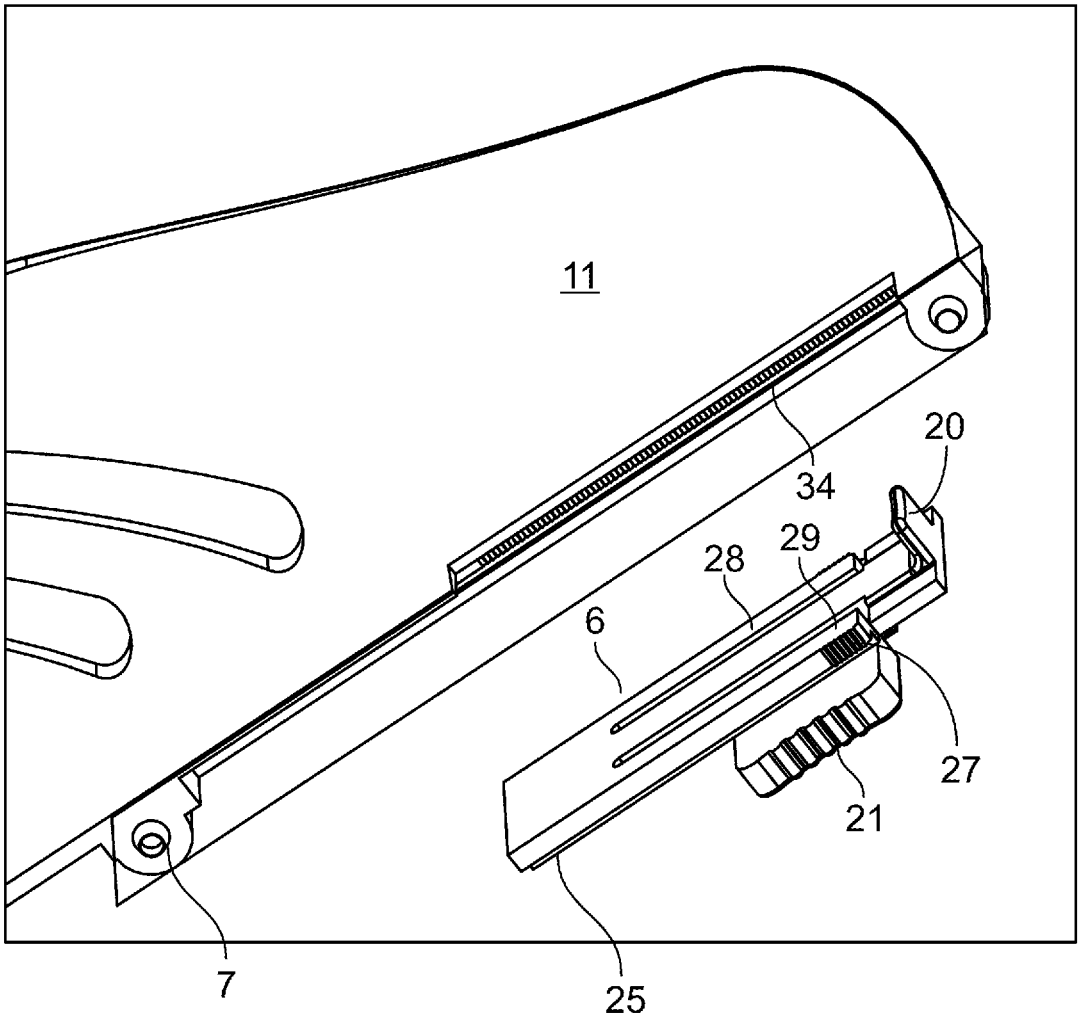
FIG. 6 is a close-up view of the can adjuster and a partial portion one side of the housing.
Figure 7:
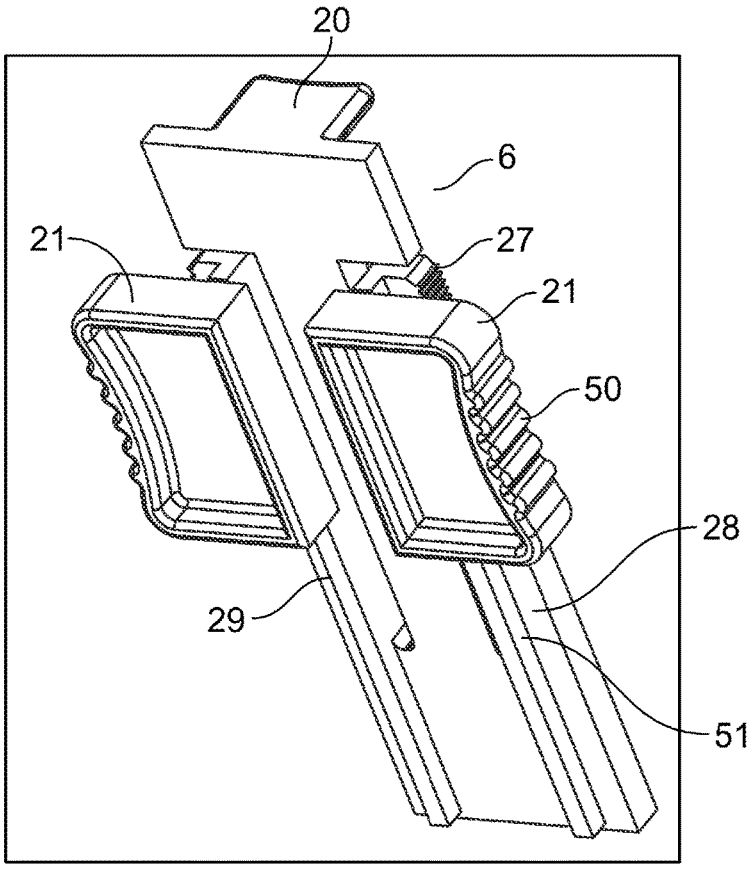
FIG. 7 is a close-up view of the can adjuster of the spray can activator shown in FIG. 1.
Figure 8:
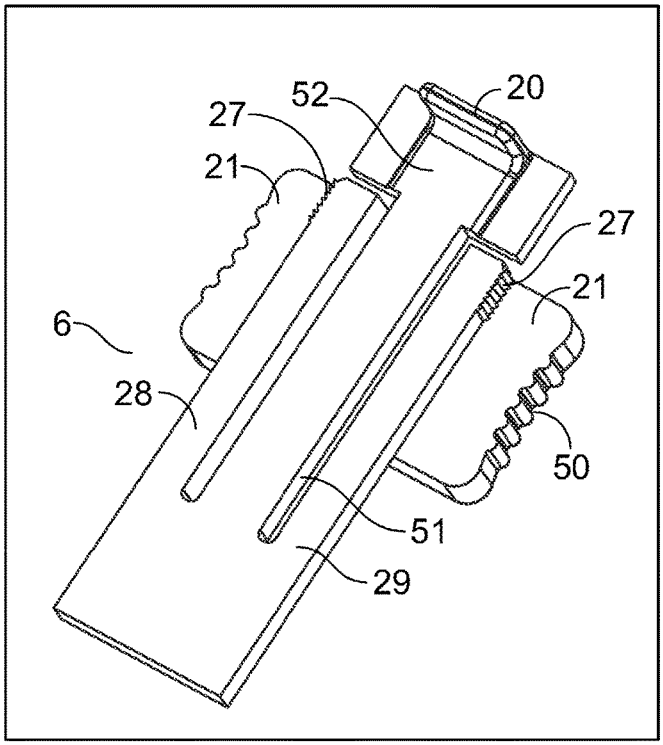
FIG. 8 is a close-up view of the can adjuster of the spray can activator shown in FIG. 1.

FIG. 2 shows the activator 1 without a spray can positioned in the sleeve 5. The activator has a two-piece housing 3 that is formed by connecting a first side 10 to a second side 11 through connectors 7 such that a sleeve or can holder portion 5*a* and a handle portion 37 are connected to form sleeve 5 and a hollow handle 80. The housing 3 and more specifically the hollow handle 80 contains and holds a trigger 4 that has a font side 4*a*, a back side 4*b*, a bottom end 4*c* and a top end 4*d*. The housing can also have a can adjuster 6 and a spray head 8, that is preferably adjustable and/or removable. The can adjuster 6 as illustrated in FIGS. 7 & 8 is captured and slidably retained in housing 3 when sides 10, 11 are connected to each other. The adjuster 6 can have a stop 20, and an adjustable lock 21 that is made up of ratchet 27 and flexible arms 28, 29 that are formed from a center portion 52 defined by slots 51. Gripping surfaces 50 are fixedly attached to flexible arms 28, 29 and provide a surface that a user can push or squeeze causing the flexible arms to bend or flex inwards towards each other. This inward bending allows ratchet 27 that is located on side 25 of the adjuster to disengage from a corresponding ratchet 34 on the housing (see FIG. 6) such that can adjuster 6 can be moved in a sliding motion relative to housing 3. This movement of the can adjuster allows spray cans of varying lengths to be placed in sleeve 5 and then have the stop 20 adjusted so that the stop 20 engages and abuts the bottom rim 24 of the can to prevent the can from moving axially along longitudinal axis 31 (see FIG. 5).

Figure 4:
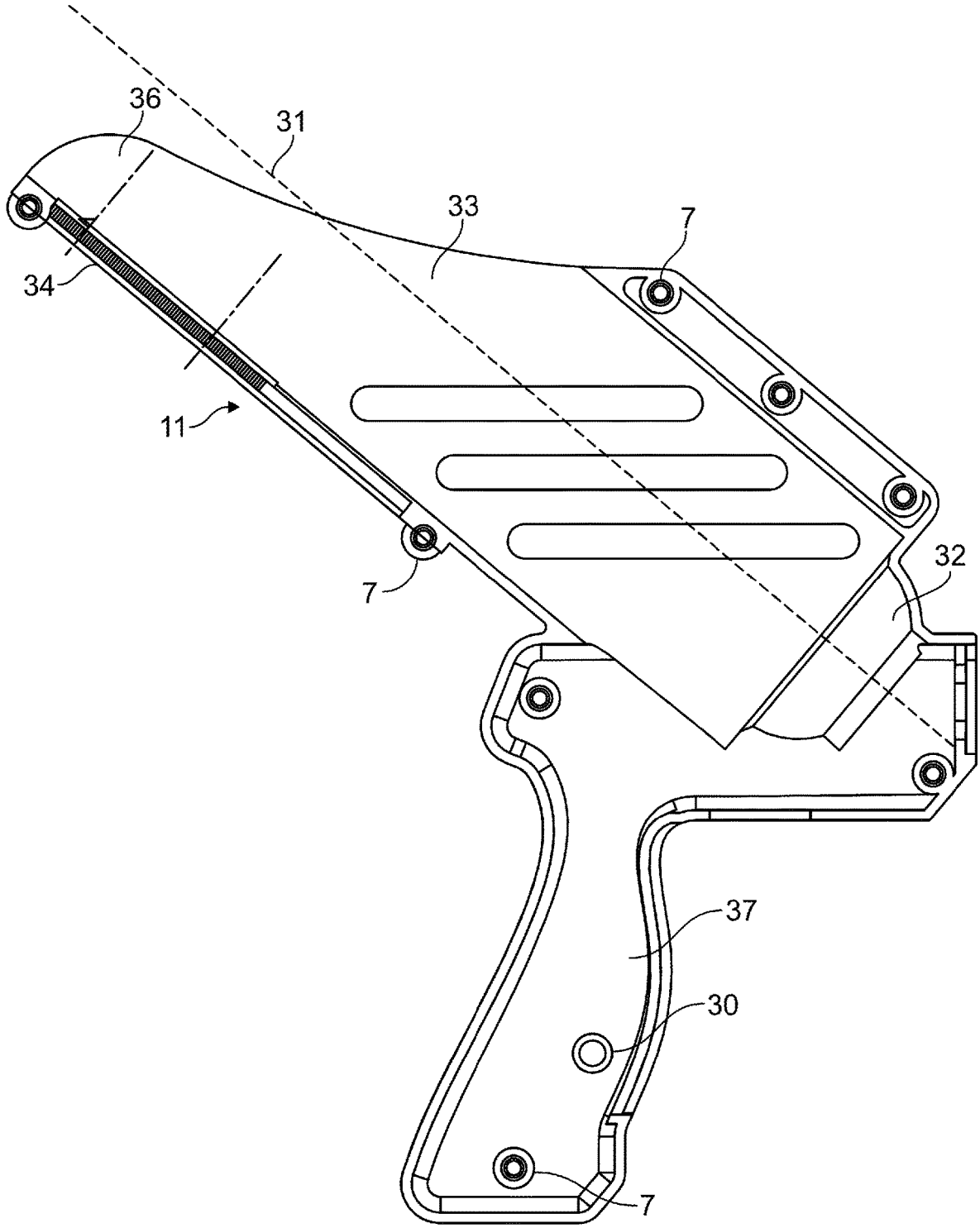
FIG. 4 is a side view of one side of the two-sided housing of the spray can activator shown in FIG. 1.
Figure 10:
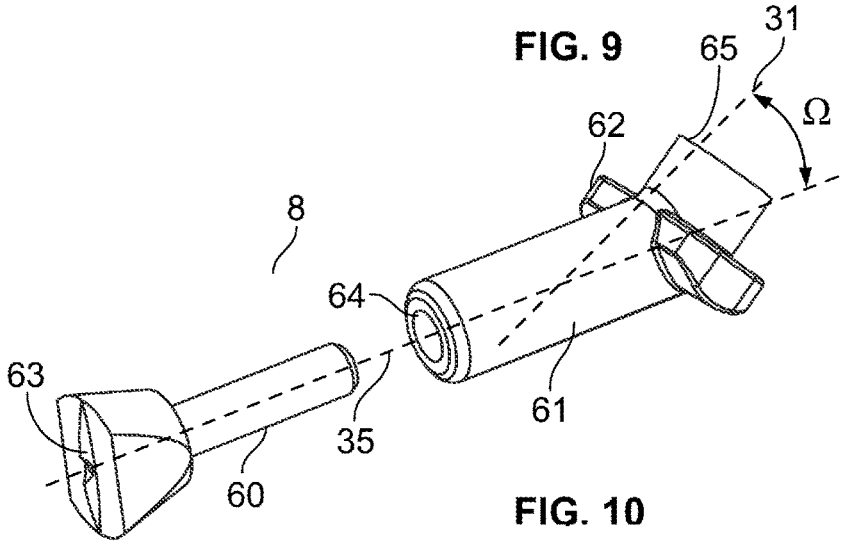
FIG. 10 is a close-up perspective view of the nozzle elbow and spray head of the spray can activator shown in FIG. 1.
Figure 11:
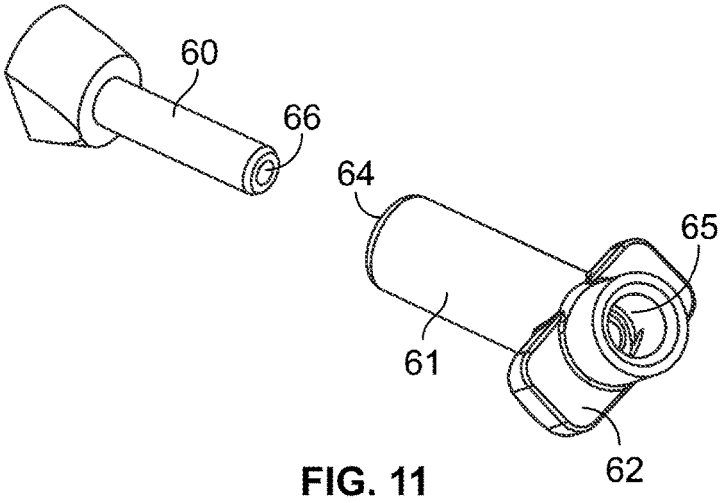
FIG. 11 is a close-up perspective view of the nozzle elbow and spray head of the spray can activator shown in FIG. 1.

FIG. 4 illustrates one side 11 of the two-piece housing 3 and shows that the can holder portion 33 of side 11 has the same longitudinal axis 31 as described above. Longitudinal axis 31 forms an angle Omega (Ω) with a center line axis 35 (see FIG. 5) of spray head assembly 8 having a spray head 60 with outlet opening 63 (see FIGS. 10 and 11). The spray head assembly 8 can be part of the activator or can be directly attached to the spray can 20. The holder portion 33 also has upper portion 36 and a lower portion 32 that is shaped to match dome configuration 22 of the aerosol spray can 20. Each side 10, 11 of the housing 3 has a handle portion 37 that captures and retains trigger 4 inside the hollow handle 80 when the two sides are connected together (see FIGS. 4 and 5).

Figure 5:
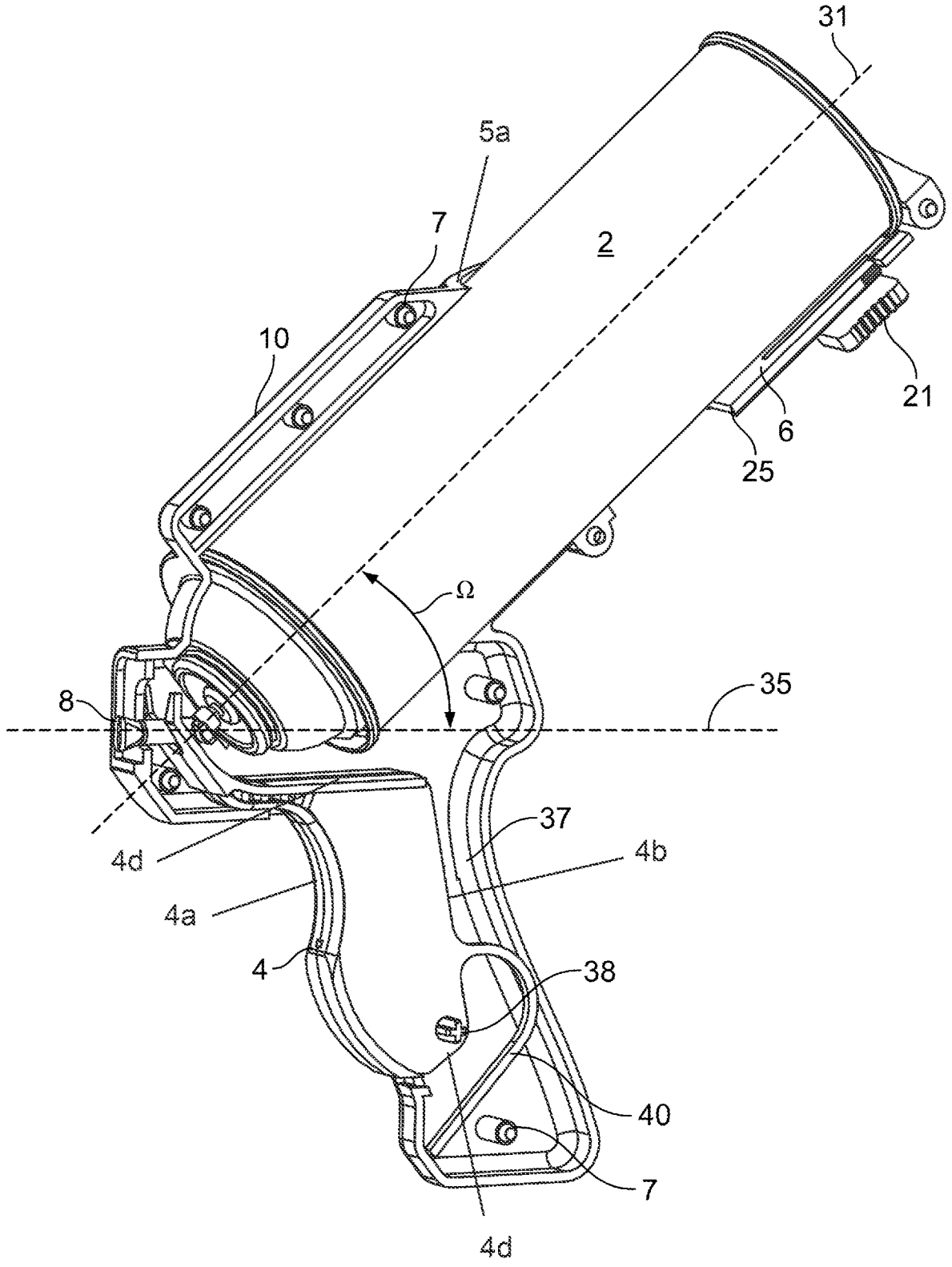
FIG. 5 is a side view of one side of the two-sided housing of the spray can activator shown in FIG. 1 having a spray can positioned within the sleeve of the activator.
Figure 9:
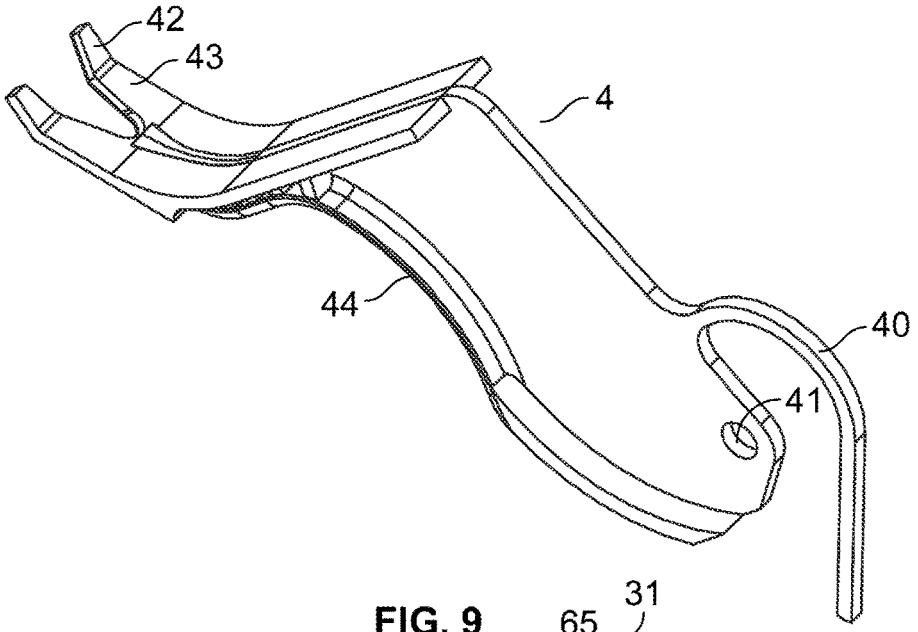
FIG. 9 is a close-up perspective view of the trigger of the spray can activator shown in FIG. 1.

Trigger 4 is preferably a single component that is pivotally positioned within the handle portion 37 of each side 10, 11 of the housing 3 (see FIG. 5). FIG. 9 illustrates a trigger configuration where the trigger has a through hole 41 located in the lower section of the trigger that is configured to rotatably engage post 38 that protrudes transversely from the handle portion 37. When the two sides 10, 11 are joined together, the post 31 is received in depression 30 located on the other side of the housing. Trigger 4 can also contain a resilient member 40 that is preferably integral to trigger 4, i.e., not a separate component from trigger 4. Resilient member 40 is configured to exert a biasing force relative to the housing such that handle 44 of the trigger 4 is pushed forward relative to the handle portion 37 of the housing 3 to a non-activated position. When a user squeezes handle 44 pulling/moving it inward toward the housing 3, the trigger moves to an activated position where the biasing force of the resilient member has been overcome by the user. Releasing of the trigger by the user causes the resilient member to force the trigger back to the non-activated position. In other words, in the activated position the resilient member 40 is force loaded such that releasing the handle 44 causes the trigger to reverse its movement back to the non-activated position. The upper or top section 43 of trigger 4 has a bearing surface 42 that is angled to engage a corresponding bearing surface 62 on elbow nozzle 61 (see FIGS. 5, 10 and 11) when the trigger 4 is moved/pivoted to the activated position.

The elbow nozzle 61 has a distal end 64 and a proximal end 65 that are in fluid communication through a conduit connecting both ends. As mentioned, the spray can 20 may be provided with spray head assembly 8. In such a configuration the proximal end 65 is directly connected to the valve portion stem 23 of the spray can 20. The proximal end of the nozzle elbow is offset from the distal end at an angle that is equal to the angle defined between the longitudinal axis 31 of the sleeve 5 and spray head outlet opening 63 (see FIG. 10). The bearing surface 62 is preferably located on one or more transverse protruding ledges that extend outward the outside surface of the nozzle elbow 61. The elbow nozzle 61 and bearing surface 42 of trigger 4 are configured such that movement of the trigger to the activated position causes nozzle elbow to move axially relative to the housing and the bearing surface 62 to abut and exert a force against the valve stem 23 along the longitudinal axis 31. Stated differently, movement of trigger 4 causes the spray head 60 and the distal end 64 of the elbow nozzle to axially along the centerline 35 of the outlet opening 63 and the proximal end 65 to move axially parallel to the longitudinal axis 31. Spray head 60 can be releasably inserted into the distal end of elbow nozzle 61.

Figure 12:
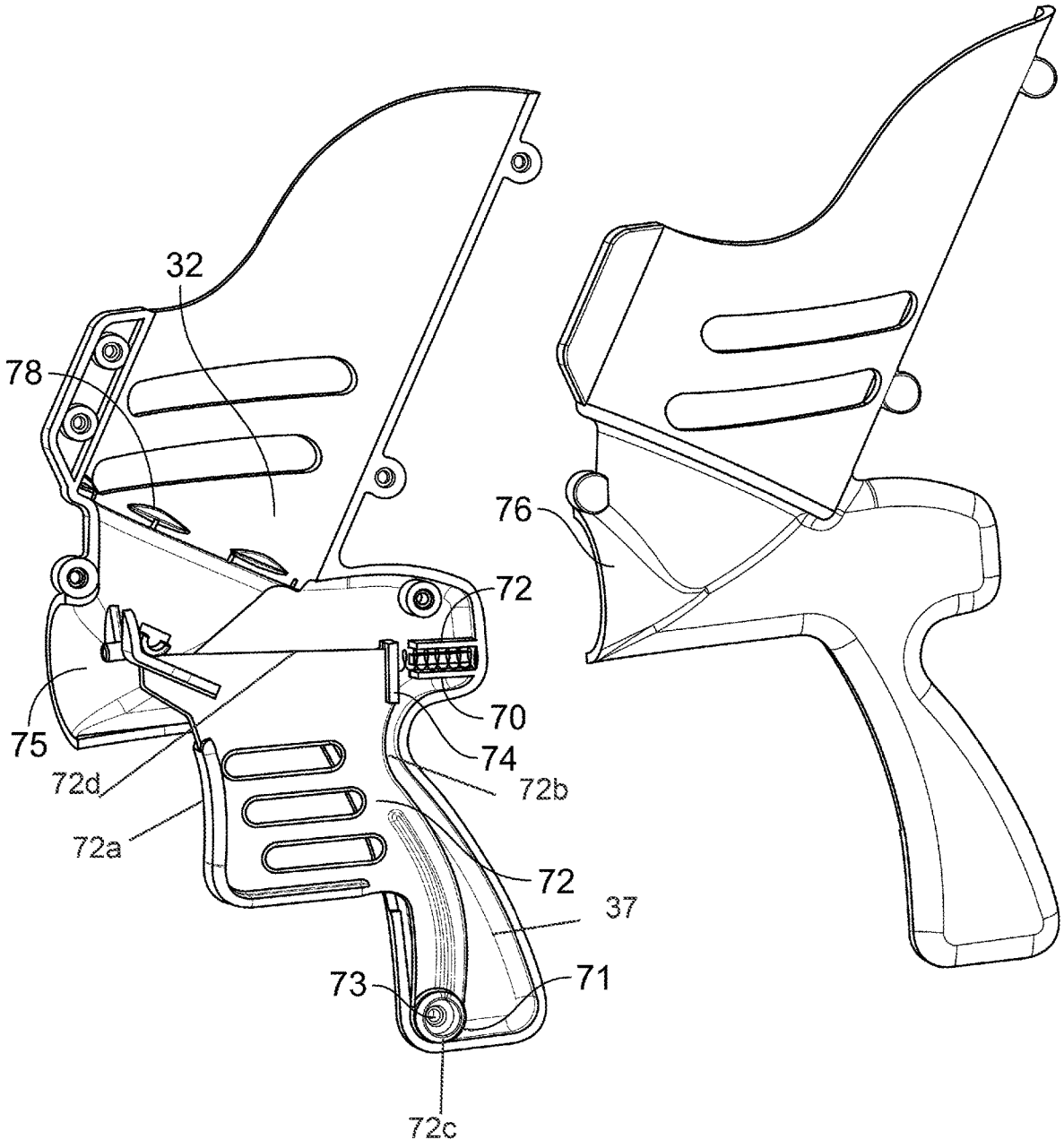
FIG. 12 illustrates a second embodiment of the spray can activator of the present disclosure where a separate biasing member is engaged with the trigger.

FIG. 12 illustrates another possible embodiment of the spray can activator of the present disclosure. Trigger 72 is preferably a single component having a font side 72*a*, a back side 72*b*, a bottom end 72*c* and a top end 72*d*. The trigger 72 is positioned in hollow handle 80 such that the back side and bottom end are fully contained within the hollow handle and is pivotally positioned within the handle portion 37 of each side 10,11 of the housing 3, however, a separate biasing member 70, is positioned between the top end and back side 74 of the trigger 72 and the biasing holder 72 located on an inside surface of one of the sides 10,11. The bottom end 72*c* of trigger 72 can have a through hole 71 that is configured to rotatably engage post 73 that protrudes transversely from the handle portion 37. This connection between post 73 and hole 71 acts as a pivot or rocker point when the trigger 72 is squeezed to activate the spray can 20.

The lower portion 32 of the holder portion contains one or more snap fittings 78 that are configured to slidably accept and secure the domed top of the spray can 20 to prevent axial movement of the spray can relative to the activator. This further alternative embodiment also has a frustoconical shaped housing portion 75,76 that surrounds and extends beyond the outlet opening 63 of the spray head assembly 8.

The invention has been described with reference to a preferred embodiment. Obviously, modifications and alterations will occur to others upon reading and understanding the preceding specification. It is intended that the invention be construed as including all such alterations and modifications insofar as they come within the scope of the appended claims or the equivalents thereof.

I claim:

1. An aerosol spray can activator comprising:

a two-part housing comprising a first side and a second side, where each of the first side and the second side has a can holder portion and a handle portion such that connecting the first side with the second side forms a sleeve and a separate hollow handle;

a trigger comprising a front side, a back side, a bottom end and a top end, where the bottom end is pivotally attached to one of the first and second sides such that the back side and the bottom end are fully contained within the hollow handle to allow the back side of the trigger to move rotationally within the hollow handle and where the front side protrudes out of the hollow handle;

a spring positioned within the hollow handle, where a first end of the spring is engaged with the back side of the trigger and a second end of the spring is engaged with an inside portion of one of the handle portions, and wherein the spring is separate from the trigger;

a snap fitting positioned on an inside portion of the housing;

a nozzle elbow having a distal end and a proximal end, where the proximal end accepts an aerosol spray can valve stem; and a spray head positioned in the distal end, where the spray head comprises an outlet opening, wherein the back side of the trigger faces away from the outlet opening.

2. The activator of claim 1, wherein the sleeve has a longitudinal axis that forms an angle with the outlet opening greater than 0 degrees and less than 90 degrees.

3. The activator of claim 2, wherein the first side and the second side are each manufactured as single parts.

4. The activator of claim 2, wherein the sleeve has a lower portion and an upper portion, where the lower portion is shaped to match a dome configuration of the aerosol spray can.

5. The activator of claim 2, wherein one of the first and the second sides comprises a post that connects to the trigger to allow the trigger to rotate relative to the post.

6. The activator of claim 2, wherein the distal end and proximal end of the nozzle elbow are offset from each other at an angle that is equal to the angle defined between the longitudinal axis of the sleeve and spray head outlet opening.

7. The activator of claim 1, wherein the trigger comprises a top and bottom, where the top comprises a bearing surface configured to engage the nozzle elbow when the trigger is squeezed by a user.

8. The activator of claim 1, wherein the nozzle elbow further comprises a bearing surface on an outside surface that is configured to engage a bearing surface on the trigger when the trigger is moved relative to the housing.

9. The activator of claim 8, wherein the bearing surface comprises a transverse protruding ledge.

10. The activator of claim 1, wherein the spray head is adjustable to change a spray pattern or spray direction.

11. The activator of claim 1, wherein the spray head is releasably positioned in the distal end of the nozzle elbow.

12. The activator of claim 1, wherein the first side has a first set of fastening points that match with a second set of fastening points in the second side when the first side and the second side are aligned to one another.

13. The activator of claim 1, wherein the two-part housing forms a frustoconical shaped portion that surrounds and extends beyond the outlet opening of the spray head.

* * * * *